United States Patent [19]

Erkenbrack

[11] 3,952,935

[45] Apr. 27, 1976

[54] CURVED PIN AND INSERTER

[75] Inventor: Kenneth B. Erkenbrack, Charlottesville, Va.

[73] Assignee: New Products, Inc., Charlottesville, Va.

[22] Filed: Mar. 7, 1975

[21] Appl. No.: 556,241

Related U.S. Application Data

[63] Continuation-in-part of Ser. No. 464,382, April 26, 1974, abandoned.

[52] U.S. Cl. ..... 227/120; 227/129; 227/134; 227/139; 227/145; 24/150 FP; 206/343

[51] Int. Cl.[2] ..... B25C 1/02

[58] Field of Search ..... 24/150 FP, 150 DP, 150 P; 206/343, 383; 227/107, 110, 120, 127, 129, 134, 139, 145

[56] References Cited

UNITED STATES PATENTS

| | | | |
|---|---|---|---|
| 2,328,983 | 9/1943 | LaPlace | 227/120 X |
| 2,403,222 | 7/1946 | Howells | 227/110 X |
| 2,692,382 | 10/1954 | Raphael | 227/107 X |

*Primary Examiner*—Granville Y. Custer, Jr.
*Attorney, Agent, or Firm*—Jones, Tullar & Cooper

[57] ABSTRACT

A curved pin provided with an enlarged planar solid or open head lying in the plane of the shank of the pin and extending inwardly therefrom together with an apparatus for holding a plurality of such pins and inserting each pin sequentially are provided. The curved pin is particularly useable by one who sews when it is desired to, for example, affix a pattern to a piece of fabric or the like. The pin's curved shape facilitates its insertion and positioning with less difficulty and more accuracy than the well known straight or "common" pin. The inserting apparatus holds a number of pins in a magazine and allows for their individual insertion by means of a rotatable, generally arcuate shaped plunger which moves each pin along an arcuate path and inserts it into the fabric at an acute angle to the fabric.

32 Claims, 22 Drawing Figures

FIG. 1
FIG. 2
FIG. 3
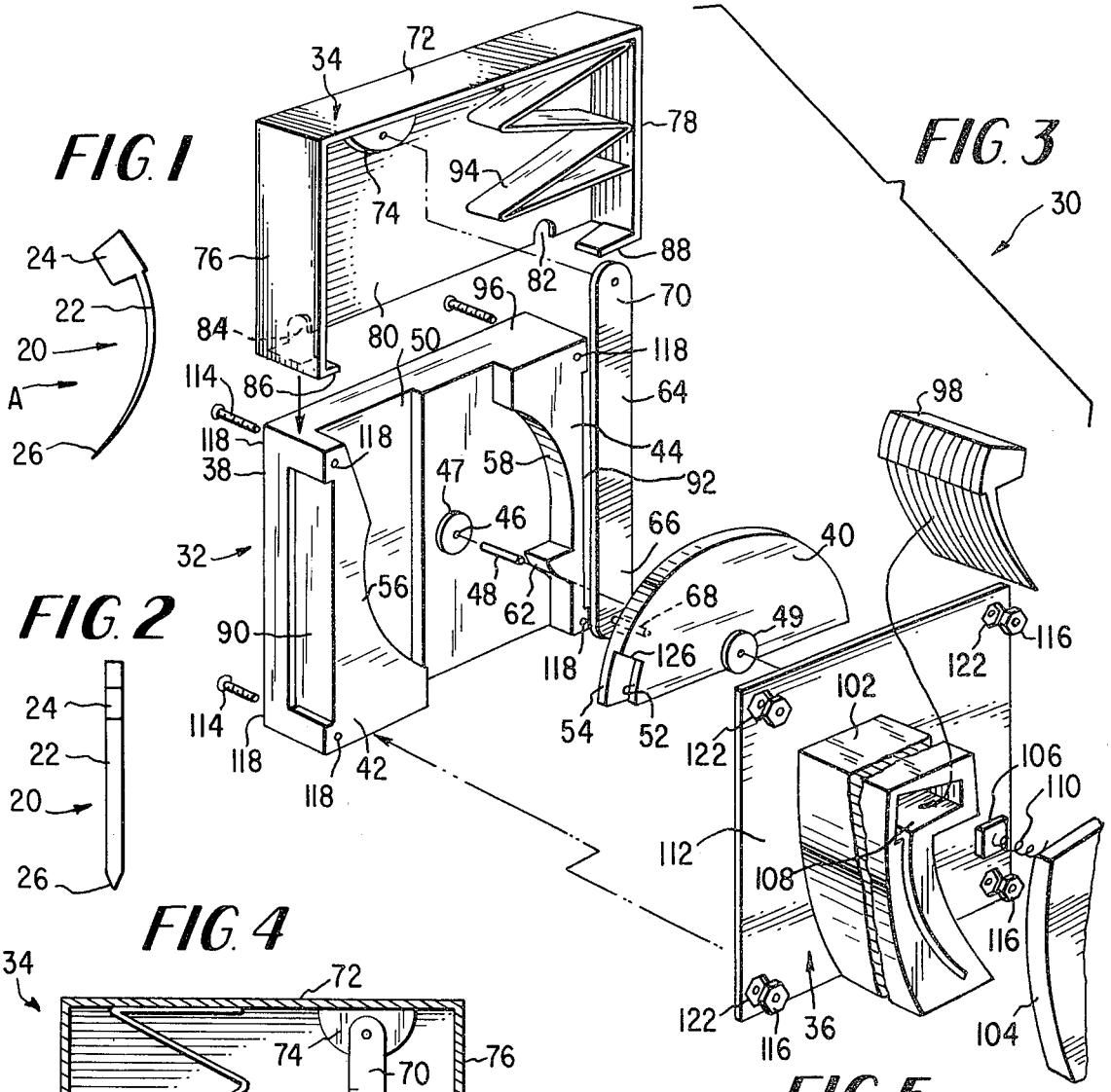
FIG. 4
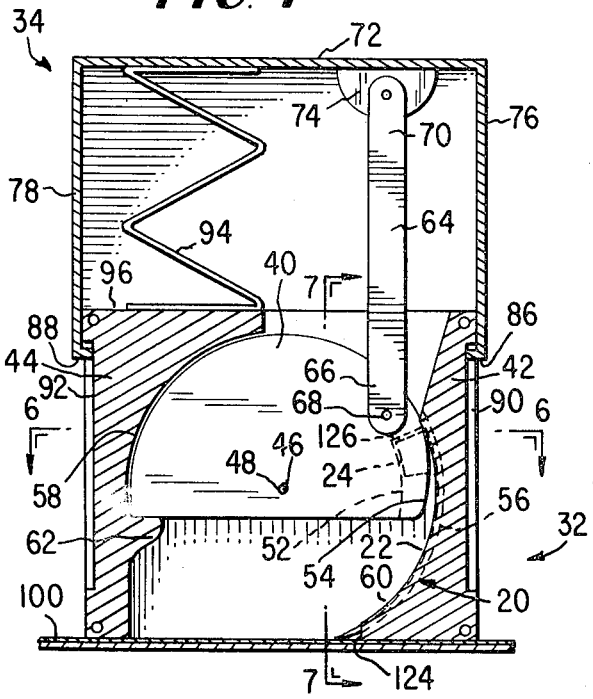
FIG. 5
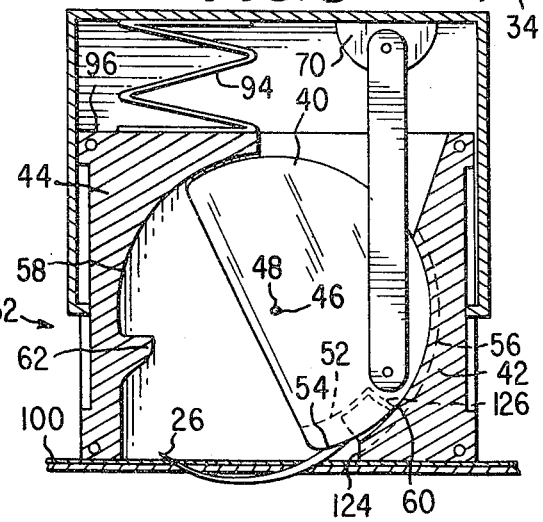

FIG. 12
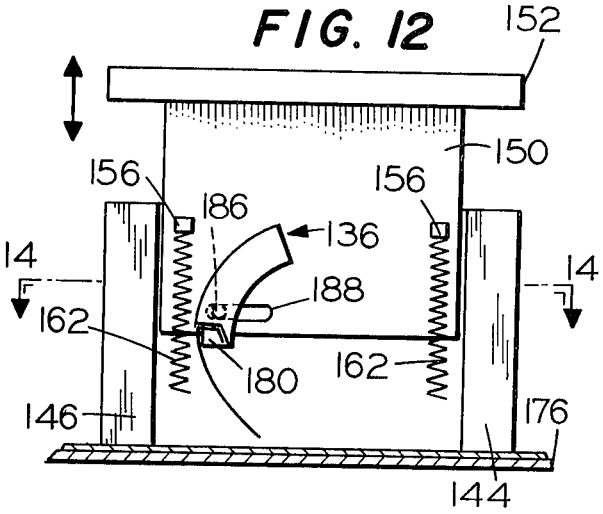
FIG. 13
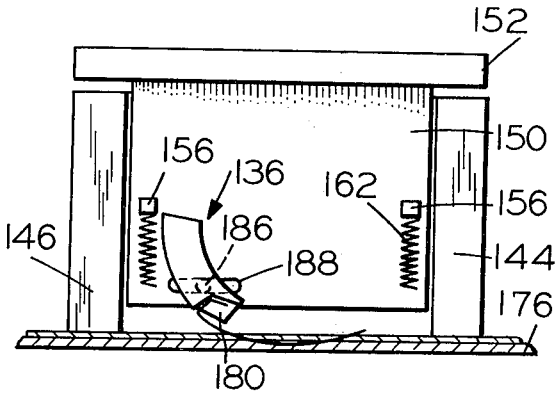
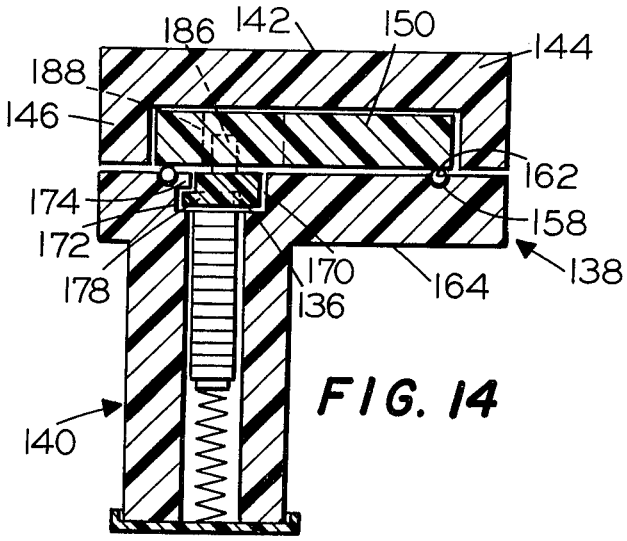
FIG. 14
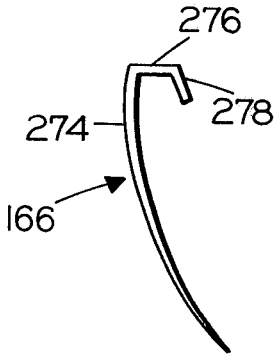
FIG. 15
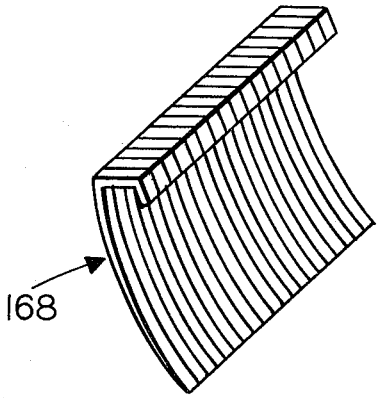
FIG. 16

FIG. 19
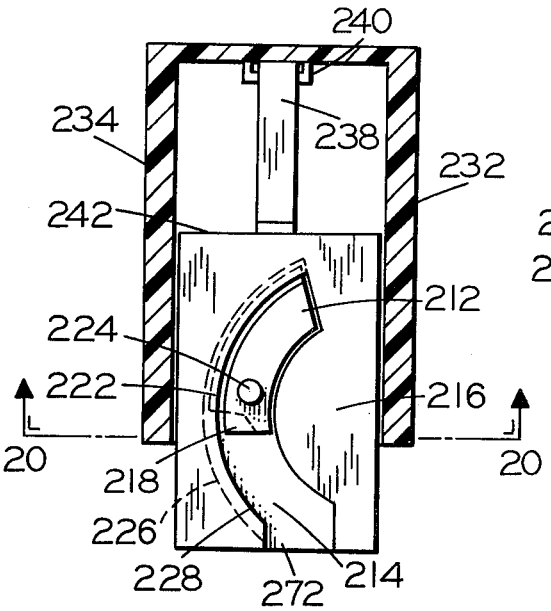
FIG. 20
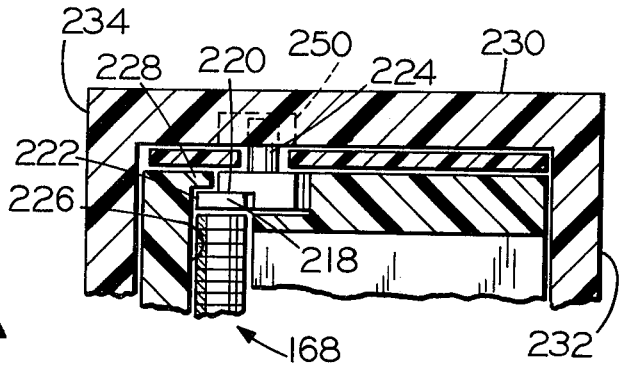
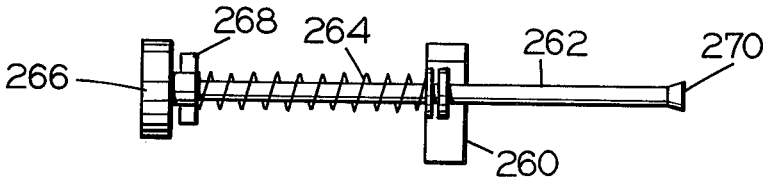
FIG. 21
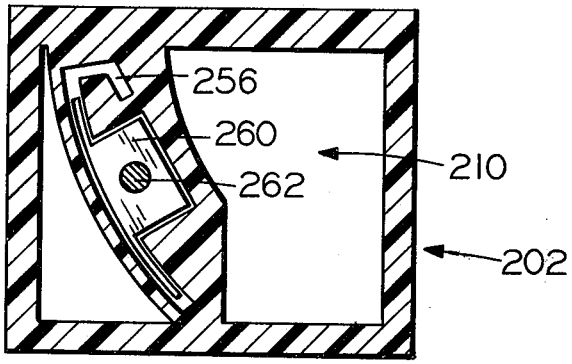
FIG. 22

CURVED PIN AND INSERTER

CROSS-REFERENCE TO RELATED APPLICATIONS

This application is a continuation-in-part of copending application Ser. No. 464,382 filed Apr. 26, 1974, now abandoned.

FIELD OF THE INVENTION

The present invention is directed generally to a curved pin provided with an enlarged planar head, and to apparatus for carrying and inserting such pins. More specifically, the pin in accordance with the present invention is provided with a shank curved to form an arc of a circle and a flat, pennant-shaped solid or open head at one end of the shank. The head is disposed in the plane of the shank and on the inner side thereof. The pin is useable in the several inserter apparatuses of the present invention with each inserter having a magazine for holding a plurality of such pins and with means for driving the pins along an arcuate course so that the pins may be insertable into a workpiece, such as a piece of fabric or similar material upon which the inserter is placed, and will serve, for example, to hold a pattern, positioned on the fabric, in place. The pin's pennant- or open-shaped head serves to hold the pin steady during its insertion, thereby preventing twisting and yawing of the pin, and also serves to facilitate easy location and removal of the pin when desired. Each inserter's drive means engages only one pin, thereby preventing the inadvertent insertion of more than one pin at a time, and inserts the pin at an acute angle to the workpiece so that the pin's point will emerge from the fabric.

DESCRIPTION OF THE PRIOR ART

The "common" or straight pin is well known in the prior art and has been used for many purposes. One of these many uses has been that of attaching patterns and the like to pieces of fabric or similar materials so that the pattern may serve as a guide for either cutting the fabric to the desired shape or for tracing the pattern onto the fabric. It has been estimated that there are more than 45 million people in this country who make their own clothes or do other types of sewing, thus it will readily be seen that the number of pins used by these people is quite large.

While straight pins have been utilized in sewing and ancillary areas for many years, they have remained a hindrance as well as an assistance for a number of reasons. A significant problem with these pins is that due to their small size and shape, they are difficult to grasp, hold, and control. The usual common pin is comprised of a straight, elongated shank portion together with a slightly larger spherical head. Since the head is quite small, it does not afford the user a particularly good grip and hence the pin is difficult to insert and hard to control. This problem is frequently the cause of injuries to either the user, since he runs the risk of sticking himself with the pin, or to the person who may be wearing the garment being pinned. While a pin prick is not dangerous, it is nonetheless uncomfortable.

Another problem with the use of straight pins in fastening patterns and the like is encountered when the user attempts to insert the pin at a point away from the periphery of the fabric. In order to do a proper job, the pin must be inserted into the material and then must exit the fabric within a short distance. While this is fairly easily accomplished at the edge of the material, it is much more difficult at a point away from the edge where one cannot get his hand under the fabric to redirect the pin after its initial insertion.

A related problem is encountered in the situation where the fabric is bulky or there are several layers placed one on top of the other. Again, with a conventional pin, it is difficult to insert the pin and to then control its progress so that it soon exits the fabric. A frequently occurring problem is one of bunching or puckering of the fabric together with movement of the pattern placed thereon. Since it is important that the material cut or marked conform as closely as possible to the shape and size of the pattern, this bunching or puckering or movement of the pattern often causes the use of extra fabric with a resultant discrepancy between the pattern and the piece made.

When working with multiple layers of fabric, only one of which may require the pattern to be affixed thereto, the problem of depth of pin penetration arises. With a common, straight pin, it is difficult to readily control the number of layers of fabric being pinned. This again is even more of a problem at an area other than the periphery of the fabric where the person doing the pinning cannot get his hand under the material in the area to be pinned and hence must try to lift the fabric with the pin to provide for the pin's emergence.

Yet another problem with the use of common pins when they are being used to "tack" or hold two pieces of material together so that they may be sewed, is one of damaging the sewing machine's needle. The pins are apt to be placed as close to the seam to be sewn as possible. Through inadvertence or mistake, the pins are sometimes placed directly in the line of the sewing machine. If the machine's needle strikes the pin, the needle may be damaged or the seam sewn incorrectly. Once the sewing has been accomplished, the pins must then be removed. Because of the handling of the material, its color, and for other reasons, it often becomes difficult to locate and remove all of the pins that had been placed in the fabric. If all of the pins are not removed, there is a strong probability that those pins inadvertently left, will manifest their presence by sticking the person who next handles the sewn pice. Again, the injury sustained is usually not serious but is nonetheless painful.

Inserting apparatus for use with various fasteners and pins are known in the prior art. For example, assemblies for use in placing drapery hooks in draperies are known. However, these machines are not suitable for use by one who sews since they cannot be utilized to insert a pin for use in adhering a pattern to a piece of fabric or the like. They additionally are cumbersome and expensive and are not adaptable to insert other than a drapery hook and therefore are inappropriate for use in attempting to insert even a straight or common pin.

SUMMARY OF THE INVENTION

It is therefore an object of the present invention to provide a curved pin useable to facilitate the pinning of material.

A further object of the present invention is to provide inserting apparatus for use with such curved pins.

Yet a further object of the invention is to provide a curved pin provided with an enlarged planar, solid or open head to facilitate the gripping, inserting and removing of the curved pins.

Still another object of the present invention is to provide inserting assemblies provided with means to hold a number of pins in a magazine and to facilitate the easy and rapid sequential insertion of a large number of such pins.

As will be discussed more fully hereinafter, the pin of the present invention has a curved shank which is provided with a sharpened first end and with an enlarged planar solid or open head portion, the head portion lying generally in the plane of the shank portion.

The pin of the present invention is easily inserted either by hand or by use of the inserter assemblies. While the prior art straight pins were provided with small heads, the pin of the present invention has a large flat solid or open head portion which allows the pin to be easily positioned when inserted by hand and also is well adapted for use in the inserter apparatus of the present invention. The shape of the pin's flat head facilitates its delivery by the inserter apparatus and retention therein until insertion, thus providing good control and preventing pin yawing or rotation during insertion. In the case of inserting the curved pin by hand, full control of the pin is also maintained due to the ease of gripping the pin's enlarged head portion, thereby preventing yawing or rotation of the pin during hand insertion. Since the pin is easily inserted and controlled, the risk of accidentally sticking or pricking the user or another is substantially lessened when the pin is inserted by hand, and virtually eliminated when the inserter assembly is employed.

The pin of the present invention is curved, and is therefore much easier to use in a situation where the user cannot place his hand under the fabric, i.e. at a point away from the periphery of the fabric. By properly holding and inserting the pin, it is possible to easily pin the workpiece without the need to exert additional pressure on the pin to lift the fabric to cause the pin's emergence. The pin, since it is curved, will penetrate to a certain depth and will then emerge, thus greatly facilitating the pinning process and insuring that the pin does not mar or nick the surface upon which the workpiece is placed.

Bunching and puckering of the fabric to be pinned, or displacement of the pattern is also eliminated by use of a curved pin since it is not necessary to gather or pinch the material in order to get the pin to emerge. Even when using heavy fabrics or multiple layers of material, the pin, due to its curved shape, will penetrate the material to a certain depth, the depth of penetration depending on the size of the pin, its curvature, and its angle of insertion, and will emerge without having caused any bunching or puckering of the material or movement of the pattern. As previously indicated, this avoidance of bunching or movement is quite important as it ensures that the material conforms to the shape of the pattern from which it is cut.

Once the pin has been inserted in place, it can be rotated and placed with its head lying in the plane of the material to be sewn. Since the pin now forms an arc of a circle, there is much less of a chance that it will be struck by the needle of a sewing machine since the machine will usually be sewing a generally straight line. Additionally, since the pin is now placed on its side, the flat, enlarged solid or open head portion will be in the plane of the material being sewn and will hence be quite visible. This fact should alleviate much of the risk of the pin being struck by the sewing machine needle and will additionally aid in the complete removal of all the pins. Since the flat head is comparatively easy to see and hold, the pins are much easier to remove than were the small headed, straight pins of the prior art.

Sewing machines are available which have a feature wherein the machine is able to sew over the area of the fabric between the points of the pin's entrance and exit of the fabric, with a reduced probability of the sewing machine needle striking the pin. With the use of such a sewing machine, when the pins are inserted perpendicularly to the sewing line, the curved pin, as opposed to the straight pin of the prior art, will tend to roll due to the fact that it is curved, thus further lessening the probability of the sewing machine needle striking the pin.

The present invention also provides several inserter apparatuses for use with the curved pins discussed hereinabove. Although the curved pins of the present invention may well be used and inserted by hand, it is often desirable, especially where a number of pins are to be inserted, to provide a means for doing so which is rapid, yet uncomplicated and inexpensive. The inserters of the present invention utilize a rotatable arcuate drive plunger in conjunction with a curved pin delivery guide to insert the curved pins in an expeditious, uniform manner. When the inserter is placed on the pattern or fabric, the force used to move the drive plunger additionally serves to hold the pattern or fabric securely in place. A refillable pin magazine is provided and holds a number of pins in a manner so that only one pin at a time may be inserted. As previously mentioned, inserting apparatus for drapery hooks and the like have been provided in the prior art but none has been useable to drive a curved pin along an arcuate path to insert the pin into a layer of fabric. While the several inserters of the present invention have somewhat differing magazine structures and orientations, together with various connecting and driving means for the drive plunger, they are all generally similar in that they all utilize a rotatable, generally arcuate, drive plunger to shear one pin from a clip of pins and to move the pin along a curved path for insertion into a workpiece such as a piece of material. In one embodiment of the inserter, the drive plunger is in the shape of a portion of a disc and is driven by a drive rod, while in alternate embodiments of the inserter, the drive plunger is arcuate in shape and has an extending drive post which engages a slot in the cap or drive rod. However, all of the drive plungers act to drive a pin along a curved path into the fabric. The curved or arcuate path which the pin is driven through by the arcuate drive plunger is defined by a track in the body of the inserter. This track and the circle of rotation of the drive plunger have the same center with the track forming a portion of a circle. If this track were extended, it would form a complete circle passing through the workpiece and back into the body of the inserter, with the workpiece upon which the inserter is placed forming a chord of this circle. Since the pin is to be inserted into the workpiece, the body of the inserter is provided with a workpiece engaging surface having an opening through which the pin passes from the inserter apparatus and is inserted into the workpiece therebeneath. This opening forms the chord of the circular extension of the arcuate path which the pin follows. Thus the pin passes from the inserter and enters the workpiece, on which the inserter has been placed, at an acute angle to the chord of the circle formed by the opening and workpiece. The pin continues to be driven along its circular path and its point emerges from the workpiece, still following the circular path, with the pin's enlarged head stopping generally at the point of insertion of the pin into the fabric.

The present inserting apparatus in conjunction with the curved pin provides a system by which patterns may be fastened to a fabric or by which layers of fabric may be pinned together that is not shown in the prior art and that performs the above tasks much more satisfactorily than the prior art methods and apparatus. The use of the apparatus permits pins to be inserted with one hand only versus the necessity of employing two hands when inserting a straight or common pin of the prior art.

BRIEF DESCRIPTION OF THE DRAWINGS

While the novel features of the present invention are set forth with particularity in the appended claims, the invention will be understood more fully and completely from the detailed description of the preferred embodiments of the invention and as set forth in the accompanying drawings in which:

FIG. 1 is a side elevation view of a solid head pin in accordance with the present invention;

FIG. 2 is a front elevation view of the pin of FIG. 1, taken in the direction of arrow A in FIG. 1;

FIG. 3 is an exploded perspective view, partly in section, of a first preferred embodiment the inserter apparatus in accordance with the present invention;

FIG. 4 is a front elevation view, partly in section, of the inserter of FIG. 3 showing the apparatus prior to the commencing of a cycle of operation;

FIG. 5 is similar to FIG. 4 and shows this inserter during an operating cycle;

FIG. 12 is a rear elevation view of the inserter of FIG. 9 with the rear portion removed and shows this inserter prior to the commencing of a cycle of operation;

FIG. 13 is similar to FIG. 12 and shows this inserter during an operating cycle;

FIG. 14 is a sectional view of the inserter of FIG. 12, taken along line 14—14 in FIG. 12;

FIG. 15 is a side elevation view of an open head pin in accordance with the present invention;

FIG. 16 is a perspective view of a clip of the pins of FIG. 15;

FIG. 19 is a front elevation view, partly in section, of the inserter of FIG. 17 taken along line 19—19 of FIG. 18;

FIG. 20 is a bottom plan view, partly in section, of the inserter of FIG. 17, taken along line 20—20 of FIG. 19;

FIG. 21 is a side view of the pin clip guide rod and plate of the inserter of FIG. 17; and, FIG. 22 is a partial cross-sectional view of the pin clip magazine of the inserter of FIG. 17 taken along line 22—22 of FIG. 18.

DESCRIPTION OF THE PREFERRED EMBODIMENTS

Figure 6:
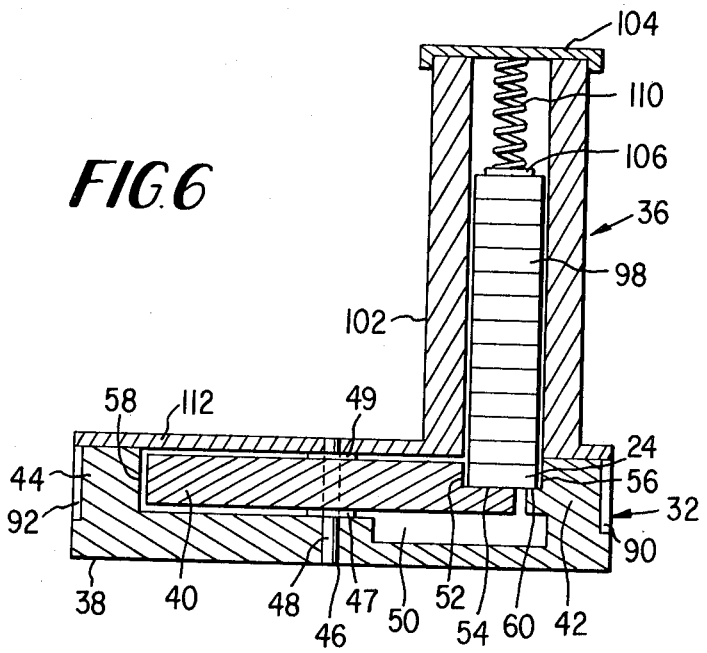
FIG. 6 is a partial cross-sectional view taken along line 6—6 of FIG. 4 and with the front portion shown.

Turning now to FIG. 1, there is shown generally at 20 a first embodiment of a curved pin in accordance with the present invention. As may be seen, pin 20 is comprised of a curved shank portion 22, provided with a generally planar, solid head 24 and a pointed tip 26. Pin 20 is of any suitable metal or other similar material, and is thin and somewhat flexible so as to be capable of undergoing a certain amount of bending without permanent distortion. While metal is preferred, other materials such as certain plastics and the like may also be used so long as they exhibit the necessary rigidity. Shank portion 22 is preferably of circular cross section, and is curved to form an arc of a circle with, as may be seen in FIG. 2, the plane of the shank being parallel to the plane of planar head portion 24 of pin 20. While the arc of shank 22 may be varied, an arc with an angle of between approximately 80° and 120° is preferred.

Head 24 of pin 20 may be, as seen in FIG. 1, generally four-sided and extends inwardly from curved shank 22. While a four-sided head is preferred, it is obvious that other head shapes, as for example, triangular or semi-circular could also be employed. The head 24, as seen in FIG. 2, is generally the same thickness as shank portion 22, both being of a thickness of approximately 1/32 of an inch or less, and is solid. The head 24 may, as will be later discussed, alternatively be open instead of solid.

Shank 22 is provided with a conventional sharpened point 26 at its end opposite head 24. As in conventional pins, the end 26 is sufficiently sharp to facilitate easy insertion into cloth and similar fabrics yet is not so sharp as to be easily dulled or blunted.

The curved shape of pin 20 facilitates its insertion and emergence from a piece of fabric or the like and is thus superior to the prior art straight pin. Because the pin's shank portion 22 is curved, it will allow the pinning of materials without the bunching or puckering often caused when a straight pin is used. In addition, the flat, enlarged, pennant shaped head 24 provides an easily grasped surface which aids in controlling the pin and which is also easily seen once the pin is in place. The enlarged head 24 also allows pin 20 to be used with an inserting apparatus as will hereinafter be discussed.

Figure 8:
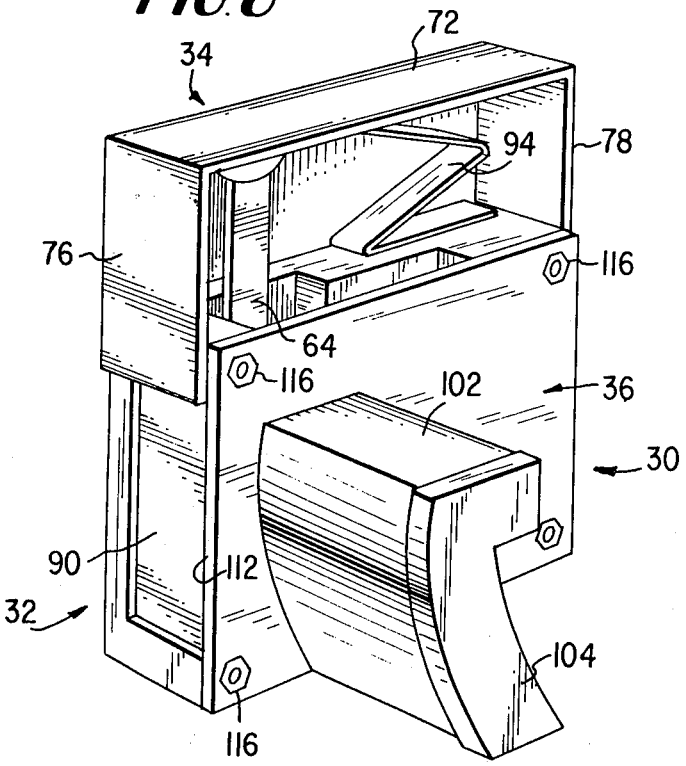
FIG. 8 is a perspective view of this inserter apparatus when assembled.
Figure 7:
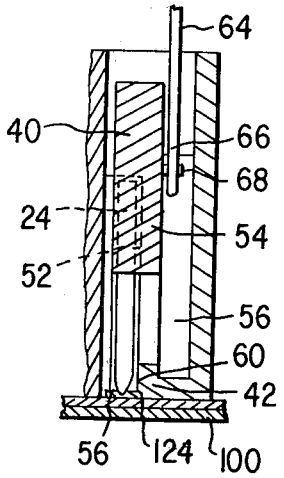
FIG. 7 is a partial cross-sectional view taken along line 7—7 of FIG. 4 with the front portion shown.

A first preferred embodiment of an inserter apparatus for use with a curved pin of the present invention is shown generally at 30 in FIGS. 3 and 8. This inserter is comprised generally of three portions; a body portion 32, a cap assembly 34 and a magazine 36 for storing pins to be inserted. This apparatus is intended to store a number of pins and to insert them one at a time as desired in a manner and by use of the mechanism as will hereinafter be discussed. The inserter assembly may preferably be made of high impact, transparent plastic so as to facilitate accurate visual positioning of pins to be inserted, or may be fabricated of other suitable materials so long as the materials used are inexpensive and durable.

Body portion 32 of inserter 30 is, as may be seen in FIG. 3, preferably formed in one piece and is comprised of a front portion 38 on the inner side of which is mounted a drive plunger 40, together with a pin guide section 42 and a drive plunger guide portion 44. Front portion 38 is of generally rectangular planar shape and is provided with a central aperture 46 through which a plunger mounting shaft 48 passes, as seen in FIG. 6. A vertical slot 50 is provided on the inner side of front portion 38 nearer the section of front portion 38 adjacent pin guide section 42 for the purpose as will be more fully discussed hereinafter. While in the preferred embodiment body 32 is formed as a single piece, it will be understood that several pieces could be joined by suitable means to form body 32.

Rotatable drive plunger 40 is generally arcuate in shape and is shown as a semi-circular portion of a disc. It will be understood, however, that drive plunger 40 could, if desired, be generally pie-shaped or quarter-circular in shape for reasons of weight reduction or lessened manufacturing costs so long as the generally arcuate shape thereof is maintained. Drive plunger 40 is positioned, by means of shaft 48 and washers 47 and 49, adjacent the inner portion of front portion 38 and between pin guide 42 and plunger guide 44, all as seen in FIG. 3. The forward end of plunger 40 is provided, at its periphery, with a pin head engaging receptacle 52 and a pin head retaining lip 54 with lip 54 being upstanding from receptacle 52, and positioned on the side of plunger 40 adjacent front portion 38, as seen in FIGS. 3 and 6. Pin guide 42 and drive plunger guide 44 are of equal thickness, and are each provided with a curved portion 56 and 58, respectively, which are the same thickness as plunger 40. These curved portions are of equal radii and the portions 42 and 44 are so formed that curved portions 56 and 58 thereof form portions of a circular path within which rotatable plunger 40 is restricted to travel. Curved portion 56 of pin guide 42 is also provided with a pin retaining track or lip 60 which may be seen most clearly in FIGS. 4–7. This lip cooperates with receptable 52 and lip 54 on plunger 40 to retain and drive a pin as will be discussed more fully hereinafter. A stop 62 may be positioned on the lower segment of curved portion 58 of plunger guide 44 and serves to restrain plunger 40 from moving rearwardly past a position where the plunger's flat diametral portion is generally parallel to the base of body 32.

An elongated drive rod 64 is joined at its lower end 66 to plunger 40 adjacent pin head receptacle 52, as seen in FIGS. 3–5, by engagement with a mounting shaft 68. At its upper end 70, rod 64 is journaled to the underside of the top portion 72 of cap 34. This attachment may be in any conventional manner so long as the upper end of rod 64 is allowed to pivot. In this preferred embodiment, a downwardly extending ear 74 is affixed to the underside of the top 72 of cap 34 and the upper end 70 of rod 64 is pivotably affixed thereto by any conventional means (not shown). Cap 34, in addition to top 72, also is comprised of side walls 76 and 78 and a front wall 80. In addition, a rear wall (not shown) may also be provided if desired. Front wall 80 of cap 34 is provided, at its lower corners, with apertures 82 and 84 for a purpose as will be set forth hereinafter. At the lower portion of side walls 76 and 78 are positioned inwardly extending cap guides 86 and 88, such guides being positionable in inwardly extending cap guide slots 90 and 92 formed in the sides of body 32. A spring 94 is adhered by suitable means at one end to the underside of top 72 and bears, at its opposite end, on the upper portion 96 of body 32. When the above described parts are assembled, they provide an apparatus for inserting one pin taken from a clip 98 of pins 20 as seen in FIG. 3 into a workpiece such as a piece of fabric or the like 100.

The clip 98 of pins 20 is formed by adhering a number of pins 20 to each other in a suitable manner and is carried in magazine assembly 36, shown in FIGS. 3, 6 and 8. This magazine assembly is provided with an elongated clip holder 102 which is of an external shape generally similar to that of clip 98 as seen in FIGS. 3, 6 and 8, and which extends rearwardly from body 32 by approximately 1 inch. Clip holder 102 is provided, at one end thereof, with a suitable access means which, in this preferred embodiment, is shown as a snap-engaging, flexible, closure means 104. Closure 104 is provided with suitable conventional means (not shown) to facilitate its secure positioning on the end of clip holder 102. A pin clip supporting track 108 is formed in an internal part of holder 102 with access to the track 108 being affored by closure 104. As may be seen in FIG. 3, track 108 is of the same general shape as pin clip 98 and supports a clip placed thereon. A suitable spring means 110 attached to closure 104 carries a pin head drive plate 106 which serves to bias the pin clip 98 along support track 108 forwardly towards drive plunger 40 as seen in FIGS. 3 and 6. Pin magazine assembly 36 is also provided, at its forward end, with a generally rectangular flat mounting plate 112. Although not shown, it will be understood that plate 112 is provided with an aperture of suitable size and shape to allow pin clip 98 to pass therethrough so as to be in communication with drive plunger 40 and the curved portion 56 of pin guide 42 as seen in FIG. 6.

As may be seen in FIG. 3, the pin magazine assembly 36 may be affixed to the rear of body 32 by means of conventional bolts 114 which pass through suitable corresponding holes 118 and 122 provided in front portion 38, pin guide 42, drive plunger guide 44 and mounting plate 112 and which engage suitable nuts 116, as seen in FIGS. 3 and 8. In addition, cap assembly 34 may also be engaged with body 32 with cap guides 86 and 88 being placed in guide slots 90 and 92 prior to the joining of body 32 and magazine 36. The portion of mounting plate 112 positioned adjacent guide slots 90 and 92 serves to further define these slots and restricts any horizontal movement of cap 34. It will be understood that, at the time of assembling body 32, cap 34 and magazine 36, the drive plunger 40 is secured to shaft 48, that lower portion 66 of drive rod 64 is attached to mounting shaft 68 carried on plunger 40, and that upper end 70 of drive rod 64 is pivotably affixed to ear 74 carried by top 72 of cap assembly 34. Apertures 82 and 84 provided on the front wall 80 of cap 34 are so placed that they allow access to bolts 114 placed in the upper holes 118 on body 32 to facilitate the assemblage of the inserter apparatus. While in the first preferred embodiment as described above, the several sections are bolted together, it will be readily seen that any of a number of assembly methods may be used.

The operation of this embodiment of the inserter assembly will now be discussed. A clip 98 of pins 20 is placed on track 108 in magazine assembly 36 through closure 104. As discussed previously, spring 110 and drive plate 106 bias the clip 98 toward the body portion 32 of inserter 30. Pressure is applied to cap 34, usually by the user pushing downwardly on top 72 with his hand. This downward movement of cap assembly 34 causes drive rod 64 to also move downwardly thus causing drive plunger 40 to rotate in a clockwise direction as seen in FIGS. 4 and 5. Plunger 40 is restrained between the inner faces of front cover 38 and mounting plate 112 with the vertical slot 50 on the inner side of front cover 38 being provided to allow space for drive rod 64 to reciprocate generally vertically.

As seen in FIGS. 4 and 6, pin 20, which is the forward-most pin on clip 98, is forced toward plunger 40 by spring 110 and drive plate 106. Pin 20, as seen in FIG. 4, engages plunger 40 with the head 24 of pin 20 being restrained in the pin head engaging receptacle 52 portion of plunger 40 and being restrained from further forward motion by pin head retaining lip portion 54 of plunger 40. At the same time, pin shank 22 is positioned in curved portion 56 of pin guide 42 and is itself, restrained from further forward motion by pin lip 60 on curved portion 56. This positioning of pin 20 may be most clearly seen in FIGS. 4 and 7.

As downward pressure is exerted on cap 34 thus compressing spring 94, and moving drive rod 64 downwardly thereby causing plunger 40 to move in a clockwise direction, as seen in FIG. 5, pin 20 is sheared from clip 98 by the action of the rear portion 126 of pin head receptacle 52. For this shearing to occur correctly, it is necessary that as seen in FIG. 6, pin head receptacle 52 be of the same width as the thickness of the pin head 24. As further downward pressure is placed on cap assembly 34 thereby causing plunger 40 to continue to rotate in a clockwise direction, the pin 20 is driven in a generally circular path, is guided by the curved portion 56 of pin guide member 42, while still being restrained by pin head engaging receptacle 52, and is inserted into fabric or workpiece 100 placed beneath the open base of the inserter assembly. The downward pressure on cap 34 also acts to hold the fabric, or a pattern placed thereon, securely in place during the pin insertion due to the engagement of the base of the inserter with the fabric or pattern. Since pin 20 is curved, it follows a curved path in workpiece 100 and the tip 26 emerges a short distance away from the pin's point of insertion into fabric 100, all as seen in FIG. 5.

Downward movement of cap 34 and hence rotation of plunger 40 is sufficient to allow the pin to be satisfactorily inserted and to make sure pin head 24 exits the lower end 124 of curved portion 56 of pin guide 42. The pin inserter 30 may then be repositioned and the same cycle repeated.

While plunger 40 is in motion during its operating stroke; i.e., whenever it is at a position other than that shown in FIG. 4, the solid portion of the plunger will cover the slot (not shown) through which pin clip 98 passes from magazine 36 to body 34, thus insuring that additional pins are not forced into the body of the inserter thereby jamming it. Only after plunger 40 returns to its starting position will it be possible for clip 98 to move forwardly thereby presenting a new pin to be inserted.

The downward travel of cap 34 will be limited be several factors. Cap guides 86 and 88 will bottom out on the lower portion of guide slots 90 and 92, the top 72 of cap 34 will almost reach the top 96 of body 32, being restricted only by compressed spring 94, and the solid drive rod 64 will limit the downward travel of cap 34. Upon release of pressure on the cap 34, it will be returned by spring 94 to the starting position as seen in FIG. 4. Upward motion of the cap will be restricted by the engagement of drive plunger 40 with stop 62 and by cap guides 86 and 88 contacting the upper limit of guide slots 90 and 92.

When one clip of pins has been completely used, a new one may easily be inserted into track 108 by merely removing the closure 104, placing a new clip 98 into position, and replacing closure 104.

While a back has not been shown for cap assembly 34, one may easily be provided so long as it is so shaped as to cause no interference with clip holder 102 of magazine 36 when cap assembly 34 is reciprocated during use of the inserter.

Figure 9:
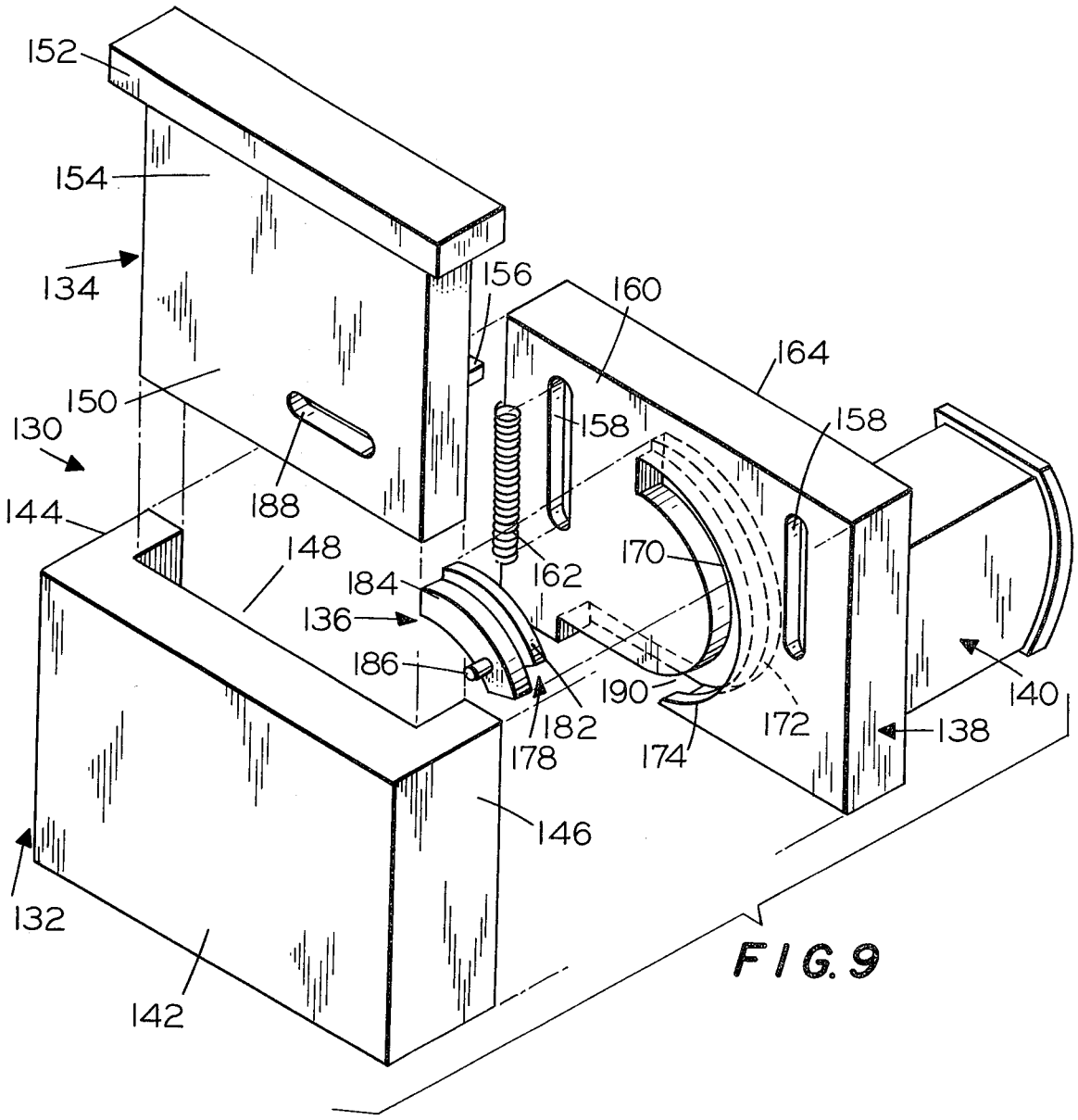
FIG. 9 is an exploded perspective view of a second preferred embodiment of the inserter apparatus in accordance with the present invention.

Turning now to FIG. 9, there is shown generally at 130 a second preferred embodiment of a pin inserter in accordance with the present invention. Inserter 130, which is generally similar to the first preferred embodiment 30 discussed above, is comprised generally of a front cover 132, a reciprocatable driver 134, a generally arcuate shaped drive plunger 136, a rear body portion 138 and a pin clip magazine 140. Front cover 132 has, as may be seen in FIG. 9, a generally planar vertical front wall portion 142 and rearwardly extending side walls 144 and 146. Front cover 132 is thus generally channel shaped and has a central longitudinal channel 148 within which reciprocatable driver 134 is positioned when the walls 144 and 146 abut rear body 138. It will be obvious that front cover 132 could include only front wall 142, and that side walls 144 and 146 could extend forwardly from rear body 138, if desired.

Reciprocatable driver 134 has, as may be seen in FIG. 9, a generally planar vertical drive bar 150 of generally the same width and thickness as channel 148. An enlarged, generally planar, actuator or push cap 152 is attached at an upper end 154 of drive bar 150. Push cap 152 provides a generally flat, wide surface upon which pressure may be exerted to reciprocate the driver 134. Cap 152 is of sufficient length and width to be unable to pass into channel 148, thereby limiting the downward travel of drive bar 150. A pair of knobs 156 extend rearwardly from the back of drive bar 150 and are positioned in a pair of spaced recesses 158 located on a forward side 160 of rear body 138. A pair of coil springs 162 are placed in recesses 158 below knobs 156 so that when inserter 130 is assembled, driver 134 reciprocates in channel 148 with its vertical travel limited by the interengagement of knobs 156 and recesses 158 and with springs 162 serving to bias driver 134 upwardly.

Magazine 140, which is generally the same in structure as magazine 36 of inserter 30, is secured to a rear side 164 of rear body 138. Further description of magazine 140 is unnecessary since it is structurally similar to, and for the same purpose as magazine 36 of inserter 30. Magazine 140 may serve to carry a clip of solid head pins 20 such as shown at 98 in FIG. 3. Alternatively, as may be seen in FIG. 15, an open head pin 166 may be joined with other similar pins to form a clip of open head pins 168 which may be carried by magazine 140. The structure and shape of open head pin 166 will be discussed in more detail hereinafter.

Again referring to FIG. 9, magazine 140 acts to deliver a curved pin through an arcuate opening in rear body 138 and into an arcuate shaped guide channel 170. Channel 170 is recessed into the forward side 160 of rear body 138 and forms an arc of a circle. Channel 170 has a pin guide track 172 portion at the inner depth of the recess, and a pin retaining lip 174 adjacent forward side 160 of rear body 138. Guide track 172 and retaining lip 174 are generally the same as their counterparts in the first inserter 30 and co-act with arcuate drive plunger 136 to retain, guide, and insert a pin into a workpiece 176 upon which the inserter is placed, as may be seen in FIGS. 12 and 13.

Figure 10:
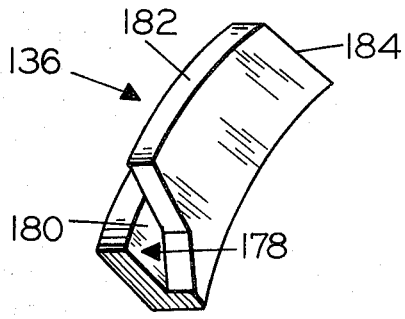
FIG. 10 is a perspective view of an arcuate drive plunger useable in the inserter of FIG. 9.

Drive plunger 136 is, as may be seen in FIGS. 9 and 10, generally arcuate in shape, of the same curvature as arcuate guide channel 170, and preferably subtends an arc of less than 90°. Plunger 136 is of the same thickness as guide channel 170, as may be seen in FIG. 14, and has a pin head engaging receptacle 178, as may be seen in FIG. 10, which is similar to and positioned comparably to receptacle 52 of inserter 30's drive plunger 40. Receptacle 178 has a pin head retaining lip 180 which, together with pin retaining lip 174, limits the forward latitudinal movement of a pin being pushed into guide channel 170 from magazine 140. Arcuate drive plunger 136 also has a circumferential, outwardly extending, guide extension 182 which mates with pin guide track 172 when plunger 136 is in guide channel 170. As may be seen in FIG. 10, extension 182 extends along plunger 136 from pin head receptacle 178 to a rear portion 184 of plunger 136. The depth of pin head engaging receptacle 178 is the thickness of a pin so that the pin is retained between the arcuate guide channel 170 on one side and both the pin retaining lip 174 and the pin head engaging receptacle 178 on the other side, during pin insertion.

Figure 11:
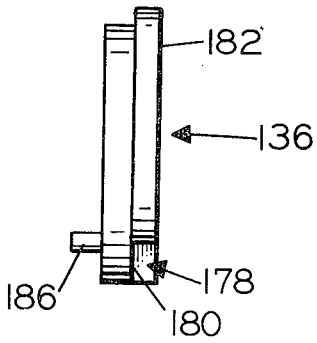
FIG. 11 is a front elevation view of the drive plunger of FIG. 10.

A drive post 186 is carried by drive plunger 136 on the opposite side of the plunger from receptacle 178, as may be seen in FIG. 11, and extends perpendicularly from the plunger forwardly of forward side 160 of rear body 138 when plunger 136 is positioned in channel 170. Post 186 is generally cylindrical in shape and is positioned in a generally oval drive slot 188 in drive bar 150, as may be seen in FIGS. 12 and 13, when inserter 130 is assembled.

The operation of inserter 130 is generally similar to that of inserter 30. A pin from a clip of pins carried in magazine 140 is forced forwardly until the head of the pin encounters pin head retaining lip 180 of arcuate drive plunger 136. The shank of the pin is positioned in pin guide track 172 and is in abutment with retaining lip 174. As in the inserter of FIGS. 3–8, the width of pin head receptacle 178 and of pin guide track 172 are the same as the width of a pin so that only one pin at a time passes from magazine 140 to track 172. The pin is sheared from the clip by plunger 136 and is carried along track 172 to pass through an opening 190 in the lower portion of rear body 138 for insertion into a workpiece 176, as may be seen in FIGS. 12 and 13. Opening 190 is of sufficient size to allow emergence of the point of the pin without contacting the body of the inserter.

Drive plunger 136 is caused to move along a circular path by reciprocation of driver 134 caused by downward pressure on push cap 152. The downward motion of drive bar 150 serves to move drive slot 188 and hence drive post 186 down. By comparing FIGS. 12 and 13, it may be seen that the relative position of post 186 in slot 188 constantly varies with vertical movement of drive bar 150, with the loci of positions of post 186 forming an arc of a circle. Vertical travel of drive bar 150 is limited by the length of recesses 158 within which knobs 156 are disposed and the driver is biased upwardly by the springs 162. Extension 182 of plunger 136 slides within pin guide track 172 and acts to keep the plunger in proper alignment. Additionally, extension 182 blocks the passage from the magazine to the channel 170 when the inserter is in an operating cycle thus insuring that the subsequent pin to be inserted is not forced out of the magazine until the plunger has returned to its starting point.

Again, as with the previously described inserter, this embodiment may be constructed of light, durable, plastic or the like and may be in any of a number of aesthetically appealing colors. The inserter is ideally suited for production by known plastic molding methods and may be assembled and secured together in any desired manner.

Referring now to FIGS. 17–22, there is shown generally at 200 a third preferred embodiment of an inserter apparatus in accordance with the present invention. Inserter 200 is again generally similar to the two previously described inserters and is intended for use to shear a curved pin from a clip of pins carried by the inserter and to insert this curved pin into a workpiece such as a piece of fabric upon which the inserter is placed.

Figure 17:
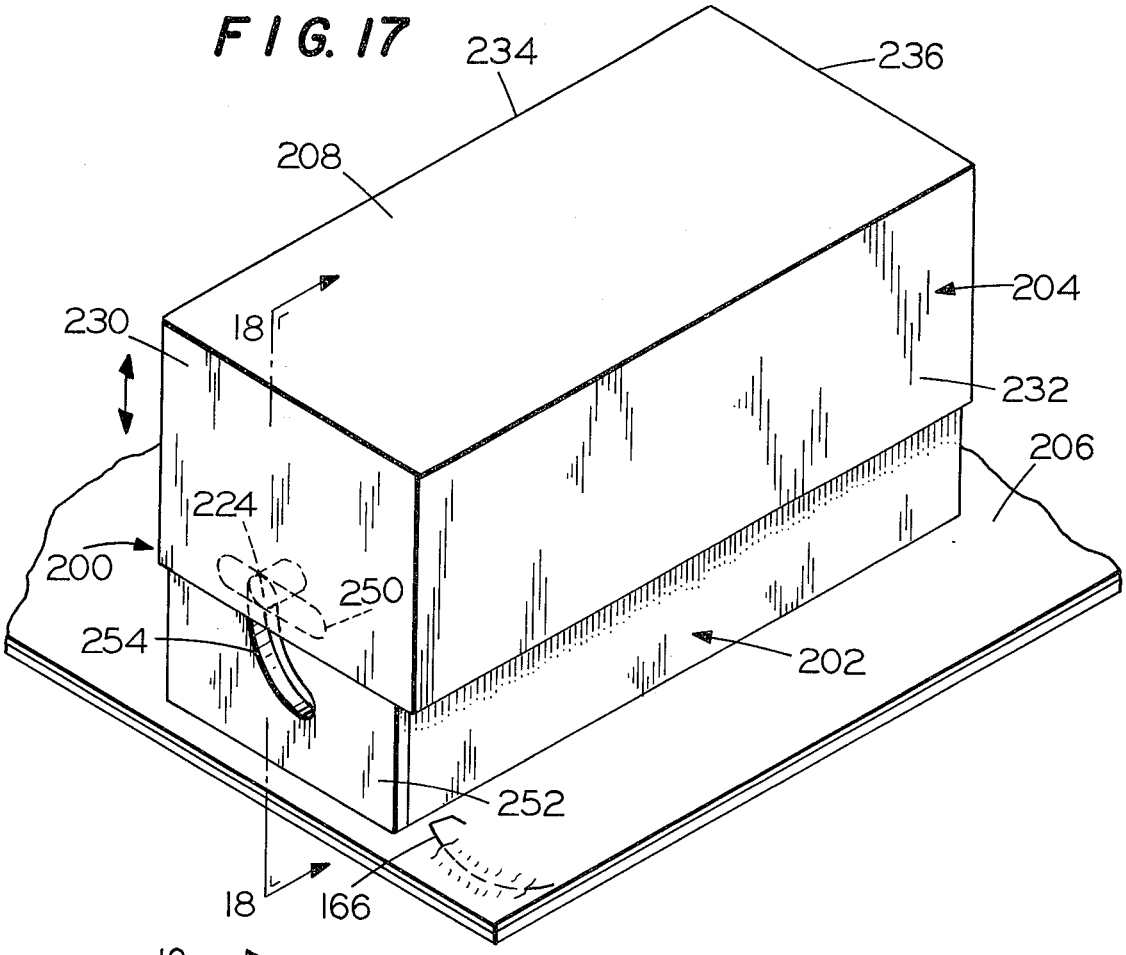
FIG. 17 is a perspective view of a third preferred embodiment of the inserter in accordance with the present invention.

As may be seen in FIG. 17, inserter 200 includes a body portion generally at 202 and a reciprocatable cap or cover at 204. Reciprocation of cap 204 causes the insertion of a pin such as an open head pin 166 into a workpiece 206 upon which the inserter 200 has been placed. As in the two previously described embodiments, downward pressure on a flat upper surface 208 of cap 204 causes rotation of an arcuate drive plunger as will now be described.

Figure 18:
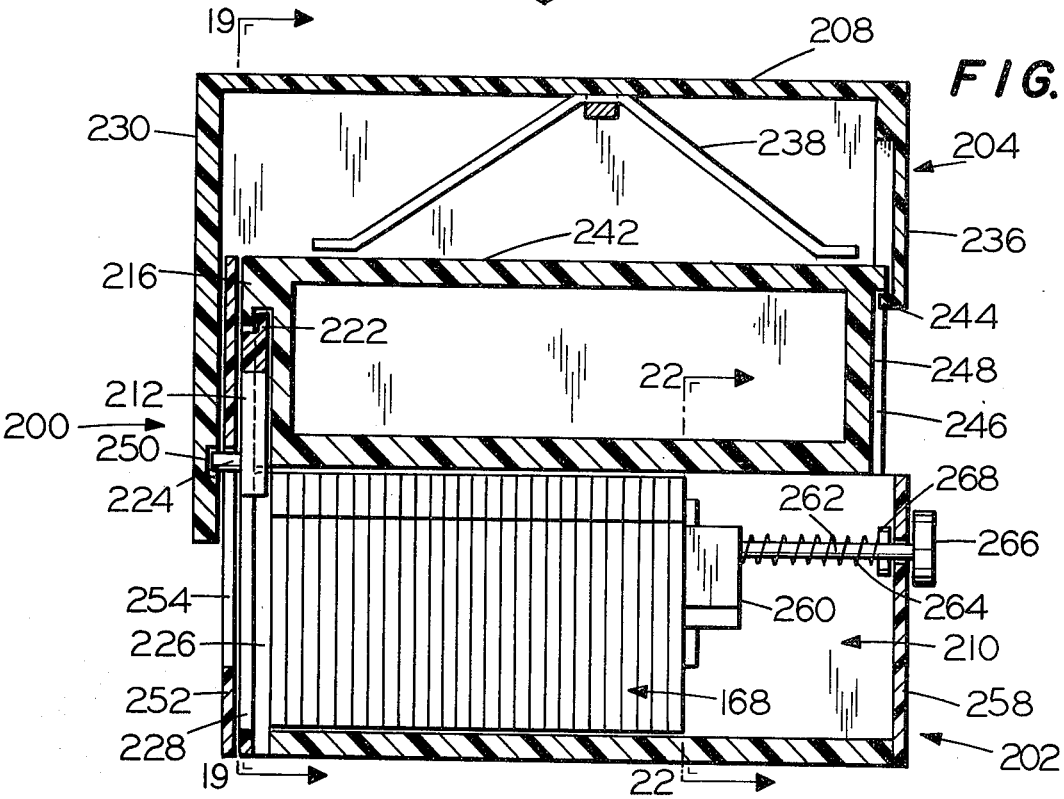
FIG. 18 is a side elevation view of a section of the inserter of FIG. 17, taken along line 18—18 of FIG. 17.

As may be seen in FIG. 18, body 202 of inserter 200 carries a clip 168 of curved pins 166 in a magazine 210, as will be discussed in more detail hereinafter, with the pins being forced sequentially forward for insertion.

By referring to FIG. 19, it may be seen that an arcuate drive plunger 212 is rotatably carried in an arcuate guide chamber 214 which is recessed in a front portion 216 of body 202. Drive plunger 212 is identical in shape and function to drive plunger 136 of inserter 130 with the only difference being one of orientation. In the inserter 200 plunger 212 is shown rotating counterclockwise while in inserter 130, plunger 136 is shown rotating clockwise, both as viewed from the front in FIGS. 19 and 9, respectively. This direction of rotation is a matter of choice and the direction of curvature of the plunger and recessed guide chamber are determined accordingly. Further, in inserter 200, the magazine 210 is located interiorly while in inserter 130 the magazine 140 is external, as shown in FIGS. 18 and 19, respectively.

Drive plunger 212 is, as may be seen in FIG. 19, arcuate in shape and preferably subtends an arc less than 90°. It is, as indicated above, structurally and functionally indentical to drive plunger 136 and has a corresponding pin head engaging receptacle 218, a pin head retaining lip 220, a guide track engaging extension 222, and an outwardly extending, generally cylindrical drive post 224. Drive plunger 212 is carried in arcuate guide chamber 214 which includes a pin guide track 226 and a pin retaining lip 228. Again, as in the prior inserter 130, plunger 212 rotates along arcuate guide chamber 214 with the extension 222 being retained in pin receiving track 226. Plunger 212 is the same width as the depth of the recessed guide chamber 214 and, as in the previously described inserters, the width of pin head receptacle 218 and of pin guide track 226 are the same as the thickness of the pin to be inserted.

Cap or cover 204 has, as may be seen in FIG. 17, an upper surface 208, a front wall 230, a pair of side walls 232, 234 and a rear wall 236. Cap 204 is, as may be seen in FIG. 18, hollow and is slidable over body 202 of inserter 200. A spring 238 is affixed by a bracket 240 to the underside of the top 208 of cap 204 and engages an upper surface 242 of body 202. The rear wall 236 of cap 204 has a cap guide 244 which extends inwardly into a cap guide slot 246 on an upper rear wall 248 of body 202. The front wall 230 of cap 204 has, on its inner side, a drive slot 250 which receives the drive post 224 of drive plunger 212. Drive slot 250, which may be seen in FIG. 18, is similar in shape to the drive slot 188 in drive bar 150 of inserter 130. Again, as in inserter 130, drive post 224 moves laterally in drive slot 250 as cap 204 is reciprocated vertically thereby causing drive plunger 212 to move along an arcuate path in guide chamber 214.

A front cover plate 252 is secured to the front portion 216 of the inserter body 202 and has a generally arcuate shaped aperture 254 therein, as may be seen in FIG. 17. Cover plate 252 covers the guide chamber 214 and drive plunger 212 and allows only drive post 224 to pass through aperture 254 for engagement with slot 250. This cover plate protects the drive plunger and prevents tampering with the drive mechanism.

A clip of pins 168 is, as was previously indicated, carried in a magazine 210 in the body 202 of inserter 200. This clip of curved pins is shown in FIG. 16 and is useable in any of the three embodiments of the inserter. As may be seen in FIG. 22, magazine 210 is located interiorly of body 202 of inserter 200. Magazine 210 has a pin clip support track 256 which is generally the same shape as the clip of pins and which extends from a lower rear portion 258 of body 202 forwardly to an opening (not shown) at the rear of arcuate guide chamber 214. A pin drive plate 260 is, as may be seen in FIGS. 21 and 22, slidably carried by a guide rod 262 and is biased into engagement with clip 168 by a suitable coil spring 264. Guide rod is provided with a knurled latch knob 266, having a latching plate 268 which engages an inner portion of lower rear wall 258 of body 202. Guide rod 262 has an enlarged inner end 270 which retains the pin drive plate 260 on rod 262 when the clip of pins has been exhausted. Pin drive plate 260 has a leading edge which extends beyond inner end 270 to permit engagement of the last pin.

In operation, inserter 200 is again similar to the previously described inserters. A clip of pins 168 is placed in pin clip support track 256, guide rod 262 and its carried drive plate 260 are inserted into the magazine and latch knob 266 is rotated to latch the rod and plate in place. Spring 264 forces plate 260 ahead thus forcing a first pin of clip 168 into pin guide track 226. Downward pressure is exerted on upper surface 208 of cap 204, moving it downwardly and causing drive plunger 212 to rotate in arcuate guide chamber 214. The pin head engaging recess 218 of plunger 212, which is the same width as the pin, shears the first pin from the clip and drives it along pin guide track 226 to an opening 272 in body 202 for insertion into workpiece 206 upon which the inserter 200 is placed. As drive plunger 212 moves in its arcuate path, the drive post 224 moves in drive slot 250 through an arc of a circle. Extension 222 on drive plunger 212 slides in pin guide track 226 to assist in retaining the drive plunger 212 in place and to also block the opening from magazine 210 to the guide chamber 214 so that additional pins cannot be moved forward until the drive plunger is back in its starting position. As in the inserter 30, the vertical motion of cap 204 is limited by the interaction of cap guide 244 with guide slot 246, and by the limits of guide chamber 214 in which drive plunger 212 moves. As in the previously described inserters, the opening 272 in the lower portion on the body 202 of inserter 200 forms a chord of the circle of rotation defined by the arcuate shape of drive plunger 212 and guide chamber 214. Pin 166 is inserted into workpiece 206 at an acute angle thereto so that the pin does not penetrate too deeply into the workpiece, and its point emerges therefrom. Pin guide track 226 is located 5/16 inch in from the edge of body 202 so that, by aligning the edge of body 202 with the edge of a pattern to be pinned to workpiece 206, the pin will exit from inserter 200 and will be inserted into the pattern half way between the pattern's outer edge and its seam line which is ⅝ inch in from the pattern edge.

Returning now to FIG. 15, pin 166 may be seen to be of generally the same shape as pin 20 of FIG. 1. Both pins 166 and 20 have an enlarged planar head of the same thickness as a shank portion, 274 and 22, respectively of the pins, but in pin 20 head 24 is solid or closed while in pin 166 the head is open and includes a generally horizontal top portion 276 and a downwardly extending leg 278. Thus the head portion of pin 166 is enlarged and planar as is the head 24 of pin 20 but is open instead of solid as in pin 20. As may be seen in FIG. 15, downwardly extending leg portion 278 of pin 166 is at an obtuse angle to pin top 276. By referring to the drive plungers of inserters 30, 130 and 200, it may be seen that in each of these the pin head engaging receptacle has a similar obtuse shape. The obtuse angle formed by pin top 276 and leg 278 is slightly greater than the obtuse angle of the pin head engaging receptacle of the several drive plungers. Since pin 166 is of resilient material, i.e. is somewhat springy and since the obtuse angle of the pin head is slightly greater than that of the drive plunger receptacle, the pin is held in place in the plunger as it is inserted or when at rest waiting for insertion. The wedging action of the pin head in the receptacle of the drive plunger insures that the pin will be retained in place during insertion and further that the pin will resist gravitational forces and will not slide out of the inserter before insertion.

Pin 166 is preferred over pin 20 for most usual usages since it is inexpensively fabricated from conventional pin metal, using a minimum of material, and is hence less expensive than is pin 20 which requires more material to make its solid head 24. However, the solid head of pin 20 can provide a decorative feature, if desired, and is more visible to one with poorer eyesight. Either pin is easily joined to other similar pins by conventional means to form a clip of pins such as clip 168 of FIG. 16.

While the above-described three preferred embodiments of the pin inserter of the present invention have differing structural specifics, all are nonetheless the same in function and purpose. In each of the three, a curved pin is sheared from a clip of pins carried in a magazine portion of the device and is driven along an arcuate path by an arcuate drive plunger for insertion into a workpiece located below an opening in the inserter. In all of the inserters, the arc through which the drive plunger and pin move define a portion of a circle with the workpiece acting to form a chord of the circle. The pin is inserted into the workpiece at an acute angle to this chord and follows the same circular path through the workpiece so that the depth of penetration of the pin into the workpiece is limited so that the pin's point will emerge from the workpiece.

In all of the embodiments of the inserter, a vertical force causes either a cap or drive bar to reciprocate. This vertical reciprocatory motion is converted to rotary motion of the drive plunger by, in inserter 30 the use of an elongated drive rod, and, in inserters 130 and 200, by the use of a drive post on the drive plunger and an oval shaped slot in the drive bar or cap, respectively. A number of driving methods for converting this vertical reciprocation to the desired circular or arcuate movement were considered, including, but not limited to, worm gears, gear trains, crank motion, belt drives, cam action, ratchet and pawl motion, and toggle joint action. However, the preferred embodiments disclosed herein were selected for cost considerations as well as ease of manufacture and assembly, notwithstanding the fact that other drive approaches might succeed in converting vertical reciprocation into circular or arcuate rotation.

In addition to the three preferred embodiments described above, various features of several of the inserters could be combined to form additional embodiments. For example, in the second embodiment of the inserter; i.e. inserter 130, the drive bar and push cap could be replaced by a cap similar to the one of inserter 30 with the cap of inserter 30 being modified to engage the drive pinion of inserter 130 in similar fashion to the inserter 200. Other similar combinations are apparent and would produce inserters having varying linkages and the like. However, as has been discussed above, all of the combinations would be the same in general concept and operation. They all operate to convert vertical reciprocatory motion of a drive cap or bar into rotary or circular motion of an arcuate shaped drive plunger to engage and shear a curved pin from a clip of pins, and to move the pin along an arcuate or circular path for insertion into a workpiece at an acute angle to a chord of the circular path, the chord being formed by the workpiece upon which the inserter is positioned.

While inserter 30 is shown as being assembled and fastened by nuts and bolts, it will be understood that this is merely exemplary and that the inserters in accordance with the present invention may be formed and joined together by any of a number of conventional methods. Ideally the various parts may be of molded plastic or similar material and are joined together by suitable methods to form inserter apparatuses which are durable, lightweight, inexpensive to produce, and capable of prolonged, trouble-free usage. It will additionally be understood that the preferred embodiments described may be modified in exterior shape to provide a more aesthetically pleasing exterior while retaining the same principles of operation.

Thus it will be seen that preferred embodiments of a curved pin and inserter that are ideally suited for use in pinning pieces of material together, in attaching patterns to fabric and for other similar uses and that are compact, efficient, light weight, easily manufactured and assembled and inexpensive have been hereinabove fully described. However, it will be readily apparent that any number of changes such as in the materials used to fabricate the inserters, the methods of fastening the parts together, the length and hence capacity of the magazines, the operation of the magazine access means, and the like may be made without departing from the scope and spirit of the present invention and hence the invention is to be limited only by the appended claims.

I claim:

1. Apparatus for use in inserting a curved pin into a workpiece, said apparatus comprising:

a body, said body defining a circular path for said pin to follow, said path terminating at an opening in said body thru which said pin passes for insertion into said workpiece;

means for supplying said pin to said circular path;

a drive plunger rotatably mounted in said body for engaging said pin to drive said pin along said circular path; and, means slidably secured to and reciprocatable with respect to said body to drive said plunger along said circular path.

2. The apparatus of claim 1 wherein said body includes a front portion, a pin guide section, and a drive plunger guide portion.

3. The apparatus of claim 2 wherein said pin guide section and said drive plunger guide portion are each provided with a curved portion, said curved portions of said pin guide section and said drive plunger guide portion defining a circular track for said drive plunger to follow.

4. The apparatus of claim 2 wherein said pin guide section is further provided with an upstanding lip, said lip defining said circular path.

5. The apparatus of claim 2 wherein said drive plunger guide portion is further provided with a stop, said stop limiting the rotation of said plunger.

6. The apparatus of claim 1 wherein said pin supplying means includes a magazine carried by said body, said magazine carrying a number of said curved pins.

7. The apparatus of claim 6 wherein said magazine is provided at one end with an aperture adjacent said circular path defined by said body.

8. The apparatus of claim 7 wherein said magazine is provided with means to bias said pins toward said aperture whereby said pins are fed sequentially through said aperture to said circular path.

9. The apparatus of claim 6 wherein said pin magazine is provided with a support track, said support track being structured to receive and support a plurality of said curved pins.

10. The apparatus of claim 9 wherein said magazine includes a closeable access opening to provide access to said support track.

11. The apparatus of claim 1 wherein said drive plunger is of a generally semi-circular disc shape.

12. The apparatus of claim 1 wherein said drive plunger is provided with a pin head engaging receptacle and a pin head retaining lip whereby said pin is restrained from lateral movement as said pin is driven in said circular path by said plunger.

13. The apparatus of claim 1 wherein said means to drive said plunger includes a cap, said cap being slidably secured to said body whereby said cap may be reciprocated with respect to said body.

14. The apparatus of claim 13 wherein said means to drive said plunger further includes a drive rod, said drive rod being affixed at a first end to said plunger and at a second end to said cap.

15. The apparatus of claim 14 wherein said cap further includes an ear, said ear projecting downwardly from the top of said cap, said second end of said drive rod being pivotably affixed to said ear.

16. The apparatus of claim 13 wherein said cap is biased away from said body by a spring positioned between a top portion of said cap and to a top portion of said body.

17. An apparatus for carrying a plurality of curved pins and for inserting each of said pins sequentially into a workpiece, said apparatus comprising:

a body, said body including a front portion, a pin guide section, and a drive plunger guide portion, said pin guide and said drive plunger guide being secured to said front portion in a spaced apart relationship, said pin guide defining a circular path for said curved pin to follow, said path terminating at an opening in said body thru which said pin passes for insertion into said workpiece;

a pin magazine carried by said body, said magazine having means to supply said pins to said circular path;

a drive plunger rotatably mounted in said body, said plunger including means to engage said pin to drive said pin along said circular path; and, a cap slidably secured to said body for reciprocal motion, said cap including means to drive said plunger along said circular path when said cap is reciprocated.

18. The apparatus of claim 17 wherein said pin guide section is provided with an upstanding lip; said lip defining said circular path for said pin to follow.

19. The apparatus of claim 17 wherein said spaced apart pin guide section and said drive plunger guide portion are each provided with a curved portion, said curved portion defining a circular track for said drive plunger to follow.

20. The apparatus of claim 17 wherein said pin magazine is provided with an apertured front plate, said plate engaging said body of said apparatus.

21. The apparatus of claim 17 further wherein said means for supplying said pins to said circular path includes a support track, said track being structured to support said plurality of curved pins, said support track terminating adjacent said circular path and being provided with means to bias said pins toward said circular path.

22. The apparatus of claim 21 wherein said plurality of curved pins are severably adhered together, each of said pins having a continually curved shank forming an arc of a circle and further having a planar enlarged head, said head being in the plane of said circle and extending inwardly from said shank and further wherein said support track is so structured to be of similar shape as said pins.

23. The apparatus of claim 17 wherein said pin engaging means of said drive plunger includes a pin head engaging receptacle, said receptacle being located at the periphery of said plunger, said receptacle further including an upstanding pin head retaining lip whereby said pin is retained in place as said plunger engages said pin to drive said pin along said circular path.

24. The apparatus of claim 17 wherein said means to drive said drive plunger includes a drive rod having a first end affixed to said plunger and a second end affixed to said cap whereby reciprocation of said cap causes said plunger to move along said circular path.

25. The apparatus of claim 17 wherein the reciprocation of said cap is limited by the engagement of cap guides carried by said cap with cap guide slots carried by said body, said guides extending inwardly from said cap into said slots, said slots being of definite length to limit the reciprocation of said cap.

26. The apparatus of claim 17 wherein said cap is provided with a biasing spring, said spring being positioned internally of said cap and forcing said cap away from said body.

27. Apparatus for use in inserting a curved pin into a workpiece upon which said apparatus is placed, said apparatus comprising:

a body having a workpiece engaging surface, said body providing an arcuate path for said pin to follow, said arcuate path terminating at an opening in said surface thru which said pin passes for insertion into the workpiece; said surface forming a chord of the circle defined by said arcuate path;

means for supplying said pin to said arcuate path;

a drive plunger rotatably mounted in said body for engaging said pin to continuously drive said pin along said arcuate path and insert said pin into said workpiece at an acute angle to said chord; and, means driving said plunger along said arcuate path.

28. The apparatus of claim 27 wherein said means driving said plunger along said arcuate path includes a cap, said cap being slidably secured to said body whereby said cap may be reciprocated with respect to said body.

29. The apparatus of claim 28 wherein said means driving said plunger further includes a drive bar, said drive bar being affixed at a first end to said cap and engaging said plunger at a second end.

30. The apparatus of claim 29 wherein said drive bar is reciprocatable with respect to said body to drive said plunger along said arcuate path.

31. The apparatus of claim 27 wherein said means for driving said plunger along said arcuate path includes a cap, said cap being hollow and slidably secured to said body whereby said cap is reciprocatable over said body.

32. The apparatus of claim 31 wherein said means for supplying said pin to said arcuate path is a pin magazine, said magazine being within said body.

* * * * *